US006095564A

United States Patent [19]

Wien

[11] Patent Number: 6,095,564

[45] Date of Patent: Aug. 1, 2000

[54] PARTITIONED BINDER HAVING A RING BINDER COMPARTMENT AND A STORAGE COMPARTMENT

[75] Inventor: Thomas M. Wien, Newport Beach, Calif.

[73] Assignee: Avery Dennison Corporation, Pasadena, Calif.

[21] Appl. No.: 09/339,150

[22] Filed: Jun. 24, 1999

[51] Int. Cl.[7] ..... B42D 1/00

[52] U.S. Cl. ..... 281/15.1; 281/29; 281/21.1; 402/70; 402/73

[58] Field of Search ..... 402/70, 73; 281/29, 281/31, 36, 37, 21.1, 15.1, 45

[56] References Cited

U.S. PATENT DOCUMENTS

| | | | |
|---|---|---|---|
| D. 135,393 | 3/1943 | Weinger et al. . | |
| D. 271,161 | 11/1983 | Compton . | |
| D. 271,699 | 12/1983 | Draddy . | |
| D. 303,548 | 9/1989 | Rexroat et al. . | |
| 352,358 | 11/1886 | Scherer . | |
| 876,062 | 1/1908 | Keiser . | |
| 1,023,466 | 4/1912 | Gareis . | |
| 1,023,834 | 4/1912 | Gareis . | |
| 1,548,499 | 8/1925 | White . | |
| 1,895,018 | 1/1933 | Wolf . | |
| 1,913,818 | 6/1933 | Petrick . | |
| 2,190,090 | 2/1940 | Tharp | 281/29 X |
| 2,354,782 | 8/1944 | Stradling et al. . | |
| 2,562,499 | 7/1951 | Lifton . | |
| 2,568,131 | 9/1951 | Segal | 281/29 X |
| 3,758,136 | 9/1973 | Guyer . | |
| 3,912,055 | 10/1975 | Malooly . | |
| 4,637,631 | 1/1987 | Baer . | |
| 4,838,724 | 6/1989 | Spence, Jr. . | |
| 4,961,596 | 10/1990 | Moor . | |
| 5,213,368 | 5/1993 | Wyant . | |
| 5,236,226 | 8/1993 | Sheffield . | |
| 5,613,791 | 3/1997 | Medenica . | |
| 5,674,021 | 10/1997 | Hutnick . | |
| 5,687,819 | 11/1997 | Lodge et al. . | |
| 5,911,441 | 6/1999 | Yamamoto et al. . | |
| 5,916,280 | 6/1999 | Lantz | 281/29 X |

*Primary Examiner*—Willmon Fridie, Jr.

*Attorney, Agent, or Firm*—Oppenheimer Wolff & Donnelly LLP

[57] ABSTRACT

A binder assembly having a partition separating a ring binder compartment from a storage compartment. The binder assembly includes a spine, a rear cover, and a front cover. The rear cover and front cover are pivotally mounted to the spine. The rear and front cover define a ring binder space for holding pages, closed on one side where the rear and front cover are secured to the spine, and being selectively open on the other three sides. A ring binder is mounted in the ring binder space near the spine. A storage cover is pivotally mounted to the front cover. The storage cover and the front cover define a storage space closed on one side where the storage cover is secured to the front cover, and being selectively open on the other three sides. First and second zippers extend around the three open sides of the binder and storage space, respectively, to fully enclose contents of the binder assembly.

20 Claims, 5 Drawing Sheets

PARTITIONED BINDER HAVING A RING BINDER COMPARTMENT AND A STORAGE COMPARTMENT

FIELD OF INVENTION

This invention relates generally to a binder and, more particularly, to a versatile binder having a partition for defining a ring binder space and a storage space.

BACKGROUND OF THE INVENTION

Loose-leaf documents and other sheet-like elements are often bound in a supporting binder. The loose-leaf documents are easily removed, and the binder is readily reused if the contents are no longer needed. Most commonly, three ring binders are used. These binders have a spine or base hingedly connected to a front and back cover. The spine or base may be a solid backing member to which a ring assembly is secured. Alternatively, the ring assembly may be secured to one of the covers immediately adjacent to a spine. The front and back covers may be formed of a relatively flexible material, or a relatively stiff material interconnected to the spine or base through a suitable flexible connection therebetween.

Other than having interior and exterior pockets for carrying loose sheets of paper, these types of binders are not designed to carry items often carried in a briefcase or backpack such as a book, notebook, calculator, cellular phone, notebook computer, palm top computer, key chain, and office supply items such as a pen, tape, marker, ruler, and etc. To accommodate these items, students usually carry their books and other school related items to/away from campus in a backpack. While on campus, the student has no need for the backpack because most of the items are left in a campus locker during the school day. Usually, only a binder and several additional items are needed for a particular class, and accordingly the student must either take the bulky backpack to class, or cram the needed extra items into his/her pockets or in the three ring binder. In another example, professionals generally carry a briefcase to/away from the office but would prefer to attend meetings with only a binder and a few additional items such as a cellular phone, small calculator, and a few key papers.

BRIEF SUMMARY OF THE INVENTION

Thus, there remains a long felt need for a relatively compact binder assembly capable of carrying loose-leaf documents and other items commonly carried in a briefcase or backpack. There also remains a need to provide a binder assembly which is aesthetically pleasing and yet rugged and mass producible at a reasonable price.

In accordance with the present invention, a partitioned binder assembly is provided which is substantially smaller than a briefcase or backpack but is capable of storing a three ring binder and other items commonly carried in a briefcase or backpack. The partitioned binder assembly includes a partition separating a ring binder compartment from a storage compartment. The binder assembly includes a spine, a rear cover, and a front cover (partition). The rear and front cover are pivotally mounted to the spine and define a ring binder space for holding pages. The ring binder space is closed on one side where the rear and front cover are secured to the spine and selectively open on the other three sides. A ring binder is mounted in the ring binder space near the spine.

A storage cover is pivotally mounted to the front cover. The storage cover and the front cover define a storage space for holding a book, notebook, calculator and other items. The storage space is closed on one side where the storage cover is secured to the front cover and is selectively open on the other three sides. First and second zippers extend around the three open sides of the binder and storage space, respectively, to fully enclose the contents of the binder assembly.

In accordance with a preferred embodiment of the invention, the binder assembly may include some or all of the following features: 1) the ring binder compartment and storage compartment may be open at the same three sides, with parallel zippers extending around the three sides; 2) the storage compartment may include a file folder, a floppy disk storage arrangement, a calculator storage arrangement, writing utensil loops, and additional pocket(s); and 3) a removable ring binder member may be sized to fit into an inner pocket of the ring binder compartment.

Other objects, features, and advantages of the present invention will become apparent from a consideration of the following detailed description and from the accompanying drawings.

DETAILED DESCRIPTION OF THE PREFERRED EMBODIMENT

Figure 1:
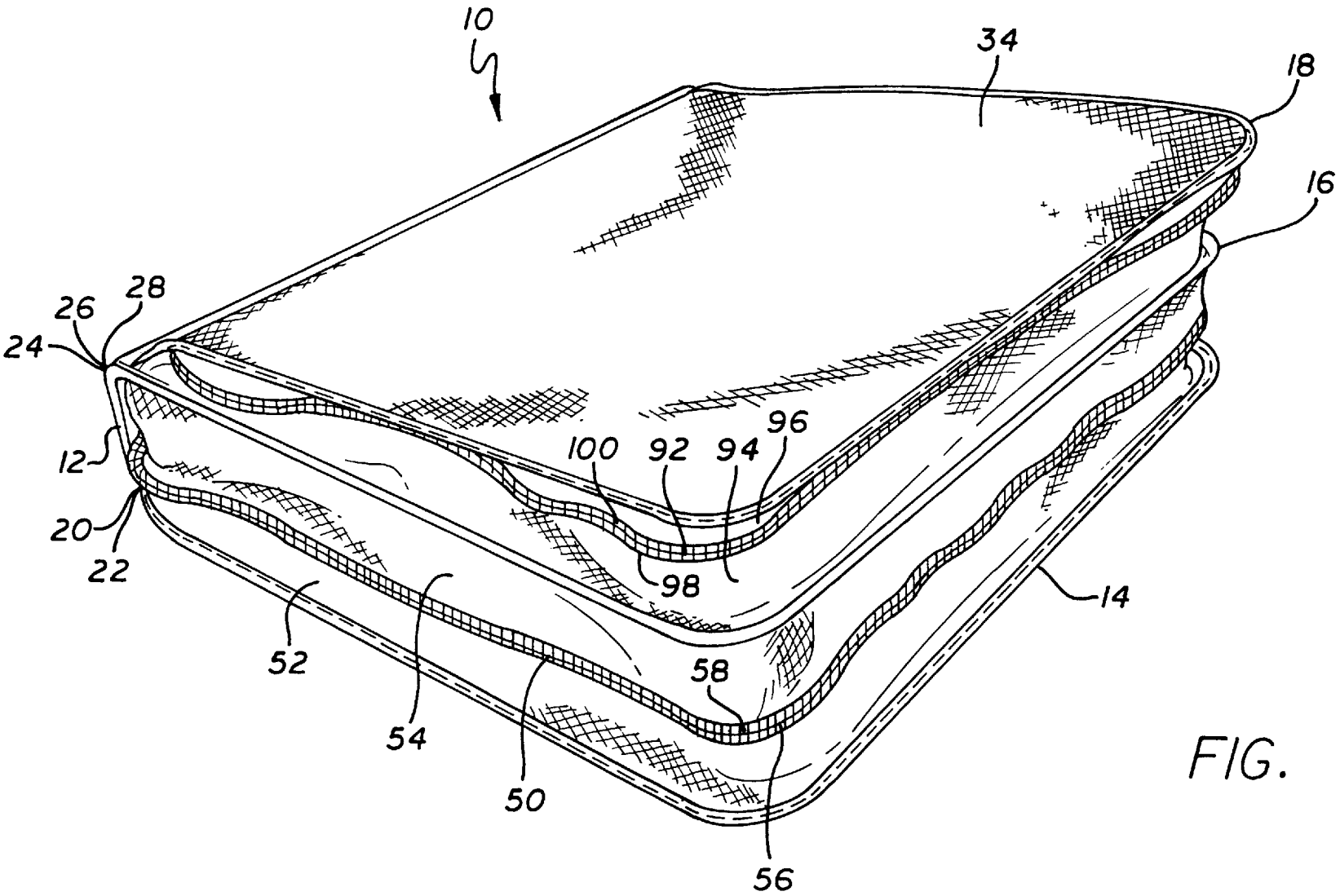
FIG. 1 is a perspective view of an exemplary binder of the present invention in a closed configuration.
Figure 3:
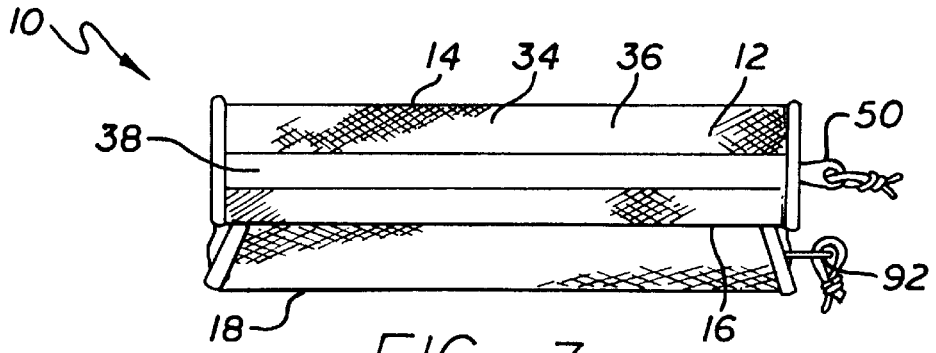
FIG. 3 is a rear view illustrating a spine of the exemplary binder shown in FIG. 1.
Figure 2:
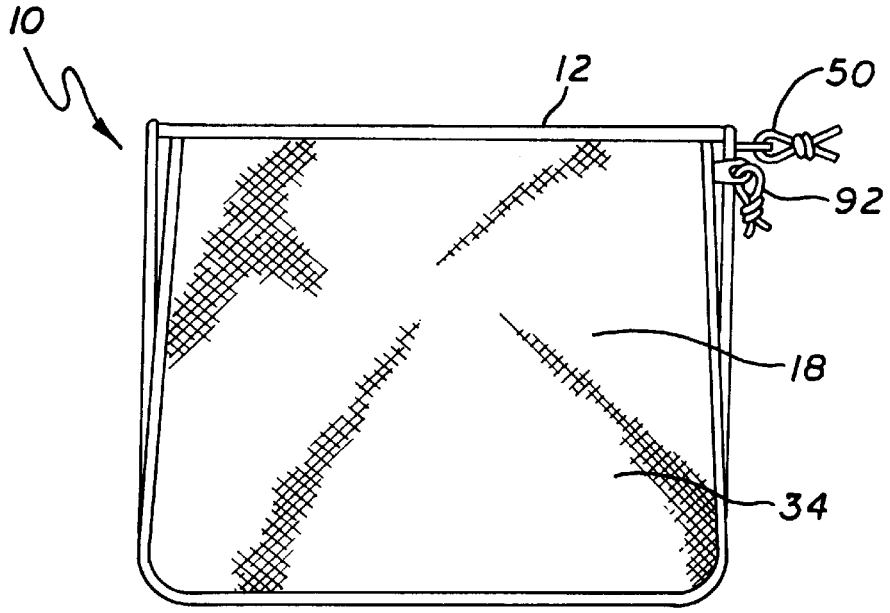
FIG. 2 is a top view of the exemplary binder shown in FIG. 1.
Figure 4:
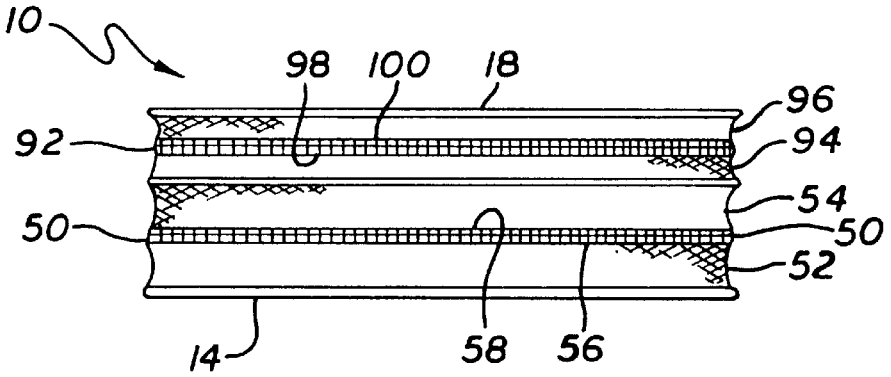
FIG. 4 is a side view illustrating the front of the exemplary binder with two parallel zippers, as shown in FIG. 1.
Figure 5:
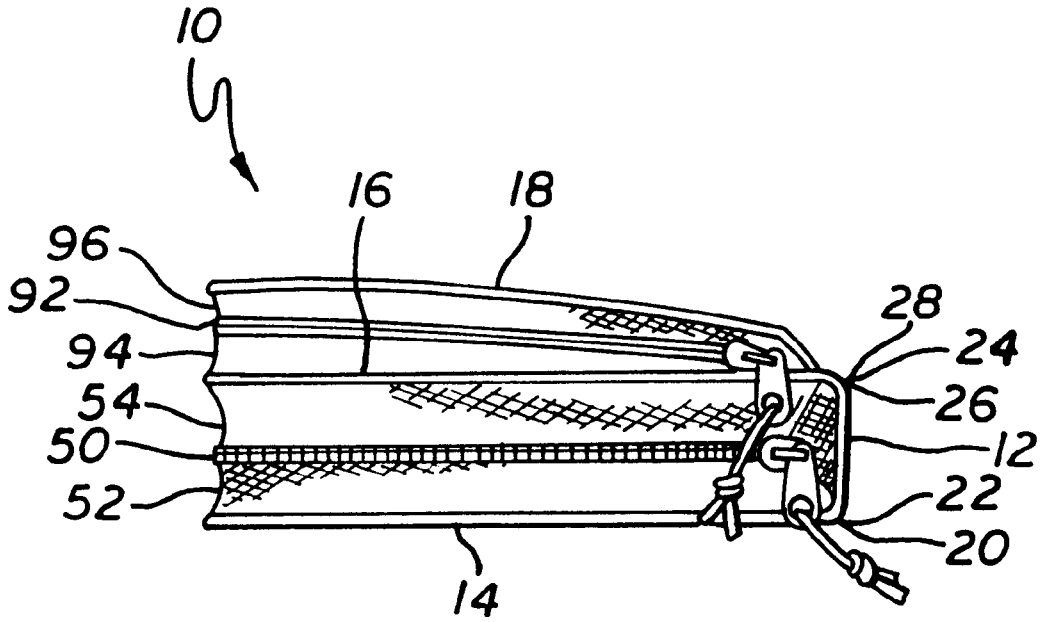
FIG. 5 is a side view illustrating the top of the exemplary binder shown in FIG. 1.
Figure 6:
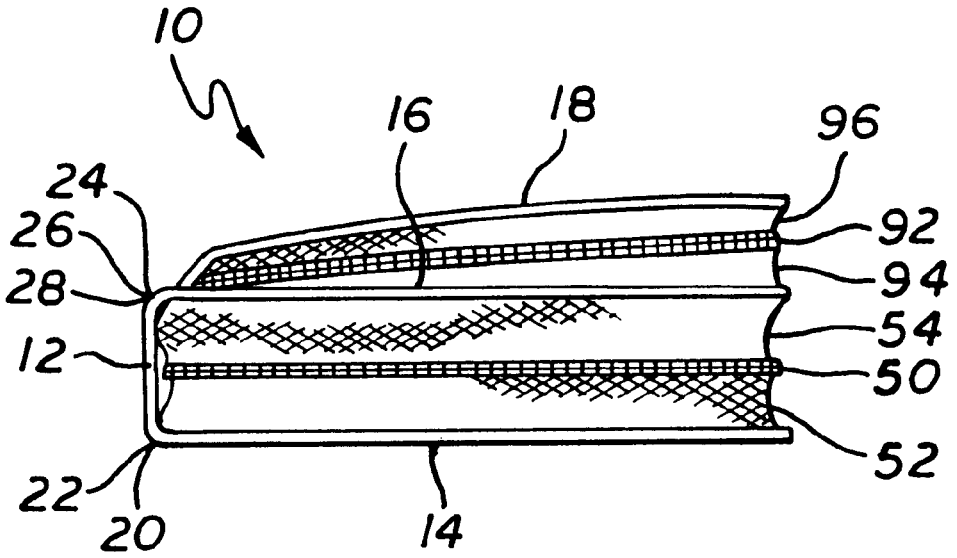
FIG. 6 is a side view illustrating the bottom of the exemplary binder shown in FIG. 1.

The present invention relates to a binder assembly having a ring binder compartment and a storage compartment separated by an intermediate panel. The ring binder compartment is suited to store any type of loose-leaf material. The storage compartment is suited for storing items generally carried in a briefcase or backpack such a book, notebook, calculator, and cellular phone. In the particular embodiment shown in the drawings and herein described, the binder is a three ring binder for the releasable binding of reports, records, and like assemblies of papers, films and the like. However, it should be understood that the principles of the invention are equally applicable to virtually any form of binder. Therefore, it is not intended to limit the principles of the present invention to the specific embodiments shown and such principles should be broadly construed.

Referring to FIGS. 1–6, a binder assembly 10 of a standard size for sheets is illustrated. Typical sheet size is A-4 size paper or paper having dimensions of 8½ inches by 11 inches. The binder assembly 10 includes a spine 12, a rear cover 14, an intermediate panel 16 and a front cover 18. The rear cover 14 is pivotally mounted to a rear edge 20 of the spine 12 by a first hinge 22, and the intermediate panel 16 and front cover 18 are pivotally mounted to a front edge 24 of the spine 12 by a second 26 and third hinge 28, respectively. Each of the covers 14, 18 and panel 16 has a width of about 11 inches and a length of about 12½ inches, and the spine 12 may have a width of about 2½ inches. The binder assembly 10 includes a three ring binder member 30 having rings 32 adapted to be opened for receiving 8½ inches by 11 inches sheet-like material having spaced holes along the inner edge for alignment with the rings 32.

Many other types of binders exist such as binders having more or less than three rings. The rings may be formed of a metal such as steel or a lightweight and inexpensive material such as a plastic. The binder assembly may also be sized to accommodate sheets larger or smaller than 8½ inches by 11 inches. For example, a typical carry-type organizer and calendar are usually about 5 inches by 7 inches. The present invention is intended to work equally well with these and other types of binders.

In the particular embodiment shown in the drawings and herein described, the spine 12, rear cover 14, intermediate panel 16, and front cover 18 are each formed of a relatively stiff and continuous construction. The covers 14, 18 and panel 16 each include an inner base plate (not shown) of paperboard or other suitable material. The base plates provide structural support and are relatively flexible. Each base plate extends substantially throughout the complete width and length of each of the covers 14, 18 and panel 16. A decorative and utilitarian enclosure or shell 34 is fabricated enclosing the base plates. Preferably, the shell 34 is formed from a woven fabric material which is treated with an UV resistant and water repellent coating. The fabric material may be formed from nylon, polyester, or polyvinyl chloride. An outer surface 36 of the spine 12 may further include a reflective strip 38 for safety purposes, wherein the strip 38 reflects light from a vehicle. In addition, a thin foam layer (not shown) may be provided between the inner base plates and the shell 34 to give the binder assembly 10 a softer feel and to protect the contents of the binder assembly 10.

Figure 7:
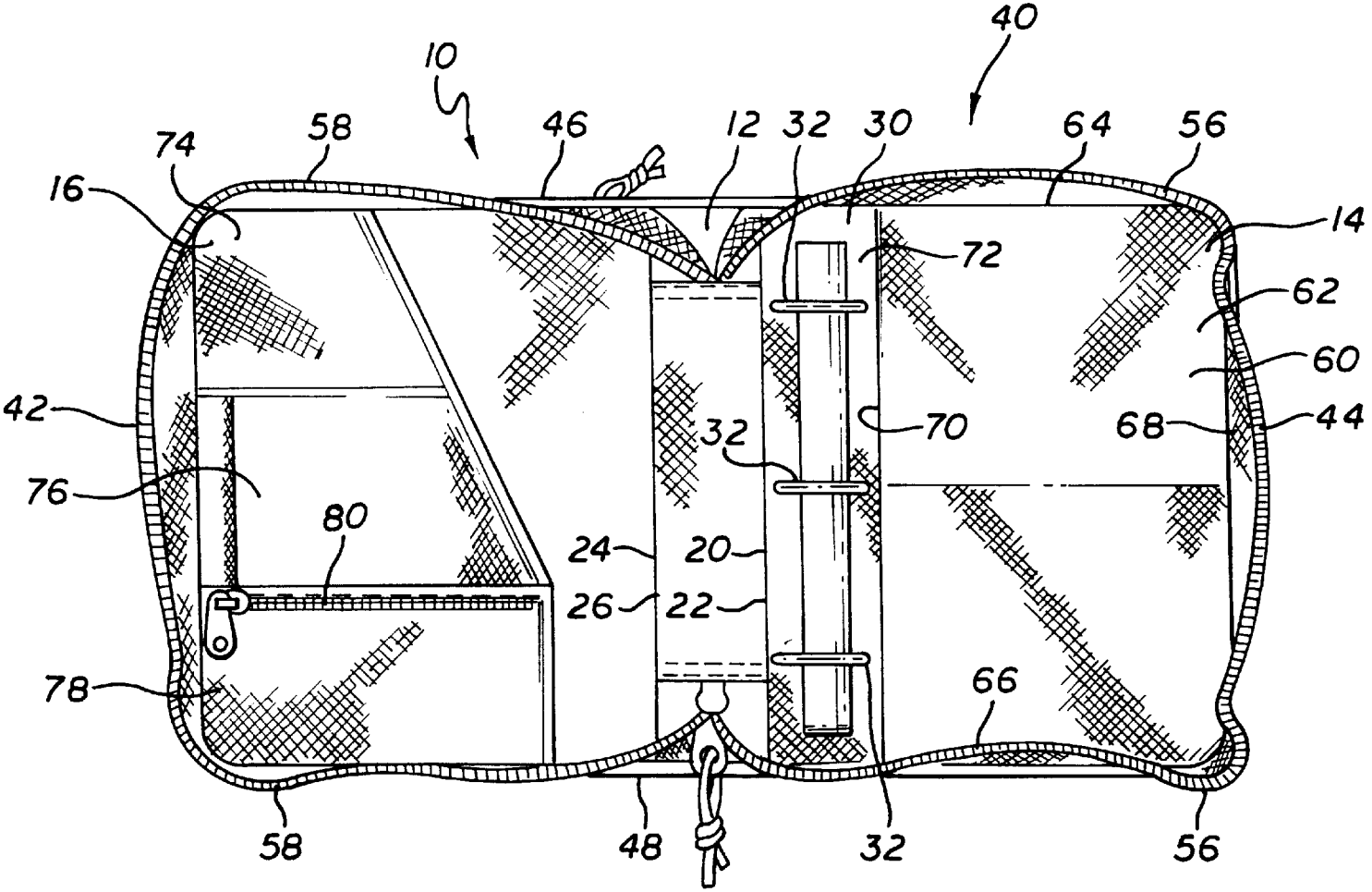
FIG. 7 is a plan view of the exemplary binder shown in FIG. 1 in an open configuration illustrating a ring binder compartment.

Referring to FIG. 7, the binder assembly 10 is in an open configuration to illustrate a ring binder compartment 40. In a closed configuration, the ring binder compartment 40 occupies the space between the rear cover 14 and intermediate panel 16 and extends outwardly to the outer edges of the rear cover 14 and intermediate panel 16. In an open configuration, the intermediate panel 16, spine 12, and rear cover 14 define the outer edges of the ring binder compartment 40, i.e., a front edge 42, rear edge 44, top edge 46, and bottom edge 48. The ring binder compartment 40 is selectively opened and closed by a zipper 50 connecting a first flexible sidewall 52 to a second flexible sidewall 54, wherein the zipper 50 includes a first 56 and second row 58 of interlocking tabs. One edge of the first sidewall 52 is attached to the rear cover 14, and the opposite edge of the first sidewall 52 is attached to the first row 56 of interlocking tabs. One edge of the second sidewall 54 is attached to the intermediate panel 16, and the opposite edge of the second sidewall 54 is attached to the second row 58 of interlocking tabs. The depth of the ring binder compartment 40 is about 2½ inches, which is the combined width of the first sidewall 52, zipper 50, and second sidewall 54.

With further reference to FIG. 7, the ring binder compartment 40 further includes a ring binder pocket 60 which extends from the bottom edge 48 to the top edge 46 of the rear cover 14 and from the rear edge 44 to a region near the spine 12 such that the dimensions of the ring binder pocket 60 are substantially the same as the outer dimensions of the rear cover 14. The ring binder pocket 60 comprises a pocket layer 62 with a top 64, bottom 66 and rear side 68 respectively attached to the top 46, bottom 48, and rear edge 44 of an inner surface of the rear cover 14. The side near the spine 12 is left unsecured to define a side insert opening 70. The three ring binder may be inserted into the pocket 60 through the side insert opening.

The rings 32 of the three ring binder member 30 are coupled to a base member 72 having dimensions similar to the dimensions of the ring binder pocket 40. The base member 72 may be coupled to the pocket 60 by slidingly inserting the base member 72 into the pocket 60, and the three ring binder member 30 may be decoupled from the pocket 60 by slidingly pulling the base member 72 out of the pocket 60. One of the advantages of such a configuration is that a user may easily replace one ring binder member with a set of papers to another ring binder member with another set of papers.

The ring binder compartment 40 further includes a plurality of pockets 74, 76, 78 on a surface of the intermediate panel 16. Each of the plurality of pockets comprises a pocket layer with three sides secured to the surface of the intermediate panel and a fourth side left unsecured to define an insert opening. In one of the pockets 78, the unsecured side includes a zipper 80 such that the pocket 78 may be selectively opened and closed.

Figure 8:
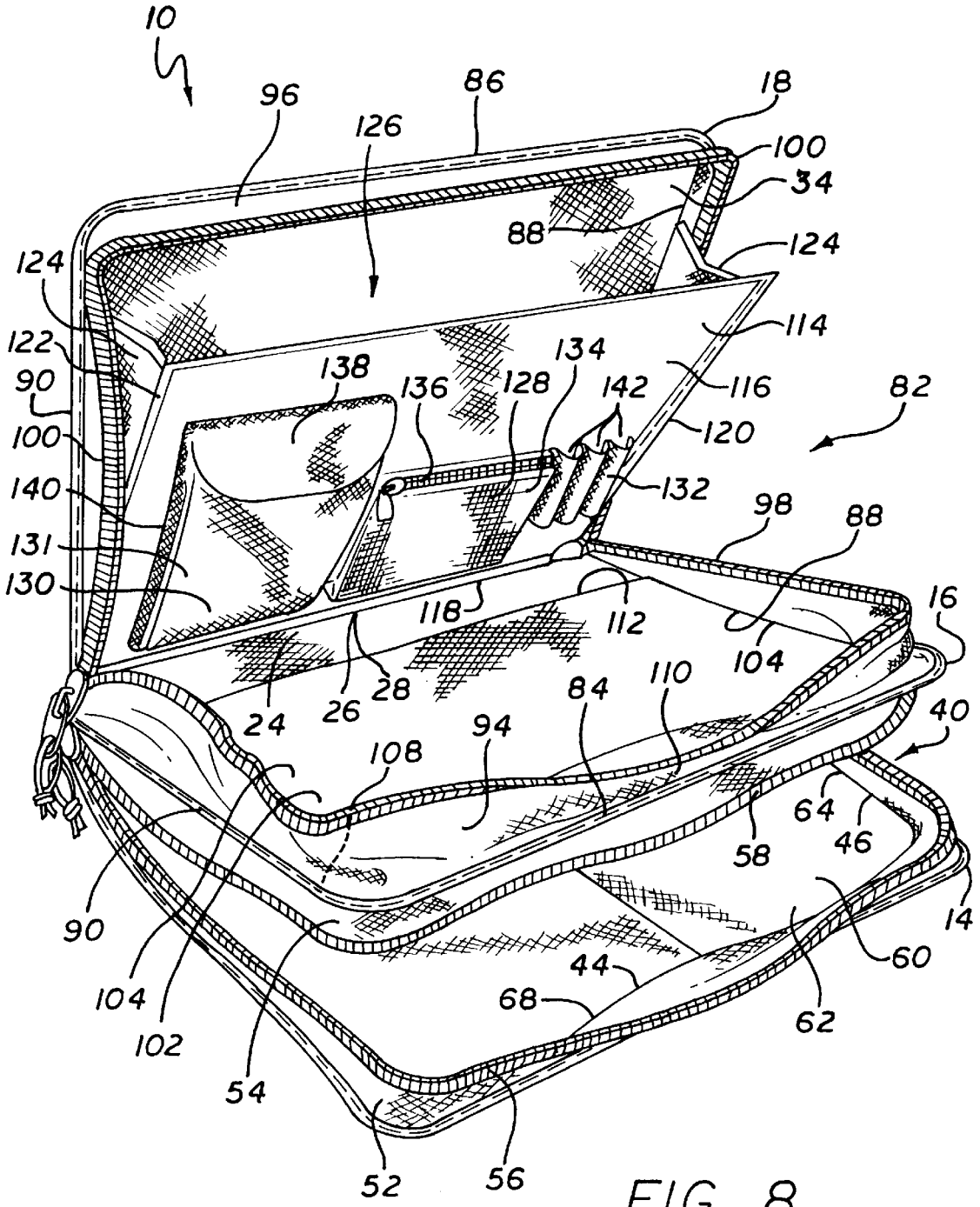
FIG. 8 is a perspective view of the exemplary binder shown in FIG. 1 in an open configuration illustrating a storage compartment.

Referring to FIG. 8, the binder assembly 10 is in an open configuration to illustrate a storage compartment 82. In a closed configuration, the storage compartment 82 occupies the space between the intermediate panel 16 and front cover 18 and extends outwardly to the outer edges of the intermediate panel 16 and front cover 18. In an open configuration, the front cover 18 and intermediate panel 16 define the outer edges of the storage compartment 82, i.e., a front edge 84, rear edge 86, top edge 88, and bottom edge 90. The storage compartment 82 is selectively opened and closed by a zipper 92 connecting a third sidewall 94 to a fourth sidewall 96, wherein the zipper 92 includes a third 98 and fourth row 100 of interlocking tabs. One edge of the third sidewall 94 is attached to the intermediate panel 16, and the opposite edge of the third sidewall 94 is attached to the third row 98 of interlocking tabs. One edge of the fourth sidewall 96 is attached to the front cover 18, and the opposite edge of the fourth sidewall 96 is attached to the fourth row of interlocking tabs 100. The depth of the storage compartment 82 is about 2 inches, which is the combined width of the third sidewall 94, zipper 92, and fourth sidewall 96. As discussed previously, the storage compartment 82 may be used to store a book, a notebook or palm top computer, a day planner, or any other relatively large item. That is, items which would normally be carried in a briefcase or backpack may be carried in the storage compartment 82.

With further reference to FIG. 8, the storage compartment 82 includes a pocket 102 which extends from the bottom edge 90 to the top 88 edge of the intermediate panel 16 and from the rear edge 86 to a region near the third hinge 28 such that the dimensions of the pocket 102 are substantially the same as the outer dimensions of the intermediate panel 16. The pocket 102 comprises a pocket layer 104 with a top 106, bottom 108, and rear side 110 respectively attached to the top 88, bottom 90, and rear edge 86 of the intermediate panel 16. The side near the third hinge 28 is left unsecured to define a side insert opening 112. Sheets of paper as large as 8½ inches by 11 inches may be inserted into the pocket 102 through the side insert opening 112.

The storage compartment 82 includes a file folder 114 attached to an inner surface of the front cover 18 and has dimensions slightly smaller than the outer dimensions of the front cover 18. The file folder 114 includes a file folder panel 116 pivotally mounted by a fourth hinge 118 which is adjacent to the third hinge 28. A top 120 and bottom side 12 of the file folder panel 116 are attached to the inner surface of the front cover 18 by flexible side extensions 124, and the side opposite the fourth hinge 118 is left unsecured to define an insert opening 126. The file folder 114 may be use to carry loose sheets of paper, spiral-bound notebook, book, or other items.

With further reference to FIG. 8, a plurality of separate storage arrangements is mounted to the file folder panel 116 such as a floppy disk storage arrangement 128, a calculator storage arrangement 130, and a writing utensil storage arrangement 132. The floppy disk storage arrangement 128 includes a meshed cover 134 closed on three sides and open on the remaining side. The three sides, which are closed, are attached to the file folder panel, and a zipper 136 is coupled to the other side to allow the arrangement to be selectively opened or closed. The calculator storage arrangement 130 includes a wall 131 having four sides. One side is pivotally mounted to the file folder panel by a hinge, while the side opposite the hinge is selectively opened and closed by a flap 138 which may be secured/unsecured to the wall by VELCRO® hook and loop material (not shown). The remaining two sides are attached to the file folder panel 116 with flexible extensions 140 which have a width of about 2 inches. It is noted that the flap 138 may be secured by other means such as a zipper, clip, or any other means known to one skilled in the art. The calculator storage arrangement 130 may be used to carry items other than a calculator such as a cellular phone, tape recorder, etc. The writing utensil storage arrangement 132 includes a plurality of loops 142 for holding writing utensils such as pencils, pens, and markers.

Although the present invention has been described in detail with regarding the exemplary embodiment and drawing thereof, it should be apparent to those skilled in the art that various adaptations may be accomplished without departing from the spirit and scope of the invention. For instance, the binder assembly may further include a second or more storage compartments. Further, the storage compartment may be selectively opened and closed by other means such as a strap and clip arrangement. It is also noted that the three open sides of the ring binder compartment and/or the storage compartment may be held closed by strips of hook and loop material in whole or in part or by any other suitable closures instead of by zippers. Still further, the storage compartment may have outer dimension substantially smaller than the outer dimensions of the ring binder compartment, wherein a hinge for the front cover is located on the central portion of the intermediate panel. The hinge for the storage compartment may be located on a side opposite the hinge for the ring binder compartment. Accordingly, the invention is not limited to the precise embodiment shown in the drawings and described in detail hereinabove.

What is claimed is:

1. A partitioned binder assembly comprising:

a spine;

a rear cover, an intermediate cover and a storage cover each being pivotally mounted to said spine;

each of said covers being of relatively stiff construction;

said rear cover and said intermediate cover defining a ring binder space for holding pages, closed on one side where the rear cover and intermediate cover are pivotally secured to the spine, and are selectively open on the other three sides;

said intermediate cover and said storage cover defining a storage space closed on one side where said panel and said front cover are secured to said spine, and being selectively open on the other three sides;

a ring binder mounted in said ring binder space near said spine;

a plurality of separate storage arrangements mounted to said assembly in said storage space;

first and second zippers extending around the three open sides of said binder space and said storage space, respectively, to fully enclose the contents of said binder assembly, and the exterior of said binder assembly consisting solely of said covers and said zippers;

whereby a compact binder assembly is provided for holding hole-punched paper in said ring binder space, and loose papers and related writing materials in said storage space, with minimal overall weight.

2. The assembly of claim 1, said rear and said front cover having an outer surface, said outer surfaces lying on a flat plane when said ring binder space is in an open position to allow viewing of sheets of loose-leaf material bound in said ring binder.

3. The assembly of claim 1, wherein said ring binder space further includes a first sidewall between said rear cover and said intermediate cover and a second sidewall between said intermediate cover and said front cover, said sidewalls being connected by said first zipper.

4. The assembly of claim 3, wherein a width of said first sidewall is about 2 inches and a width of said second sidewall is about 1½ inches.

5. The assembly of claim 1, wherein each of said covers and said spine include a base plate covered on both sides with a woven fabric material.

6. The assembly of claim 1, wherein each said cover has a width of about 11 inches and a length of about 12½ inches.

7. The assembly of claim 6, wherein said ring binder is dimensioned to receive sheet material having a width of about 8½ inches and a length of about 11 inches.

8. The assembly of claim 1, wherein said ring binder has rings adapted to be opened for receiving sheet material having spaced holes along an inner edge for alignment with said rings.

9. The assembly of claim 1, wherein said plurality of separate storage arrangements comprise:

a file folder including a wall pivotally connected to said front cover by a hinge on one side and by flexible extensions on two adjacent sides;

a storage arrangement adapted to receive floppy disks, said storage arrangement including a meshed cover closed on three sides and being selectively opened and closed on the other side, said three sides being attached to said pocket wall, and a third zipper extending along the other side to fully enclose said storage arrangement; and a calculator storage arrangement including a calculator wall closed on three sides and being selectively open on the other side, said three sides attached to said pocket wall, and a flap extending over the other side to fully enclose said calculator storage arrangement; and at least one loop attached to said pocket wall for holding one or more writing utensils.

10. A binder assembly comprising:

a spine;

a rear cover and a front cover, each being pivotally mounted to said spine;

said rear cover and said front cover defining a ring binder space for holding pages, closed on one side where said rear and said front cover are secured to said spine, and being selectively open on the other three sides;

a ring binder mounted in said ring binder space near said spine;

a storage cover being pivotally mounted to said spine;

said storage cover and said front cover defining a storage space closed on one side where said storage cover is secured to said front cover, and being selectively open on the other three sides;

first and second closures extending around the three open sides of said binder space and said storage space, respectively, to enclose the contents of said binder assembly; and the exterior of said binder assembly consisting solely of said covers and said zippers;

whereby a compact binder assembly is provided for holding hole-punched paper in said ring binder space, and loose papers and related writing materials in said storage space with minimal overall weight.

11. The assembly of claim 10, further comprising a plurality of separate storage arrangements mounted to said assembly in said storage space.

12. The assembly of claim 10, wherein each of said covers and said spine include a base plate covered on both sides with a woven fabric material.

13. The assembly of claim 12, further comprising a foam material adjacent to outer surfaces of said base plate of said rear cover, said front cover, and said storage cover.

14. A partitioned binder assembly comprising:

a spine;

a rear cover, an intermediate cover and a front cover, each being pivotally mounted to said spine;

said rear cover and said intermediate cover defining a ring binder space for holding pages, closed on one side where said rear cover and said panel are secured to said spine, and being selectively open on the other three sides;

said intermediate panel and said front cover defining a storage space closed on one side where said panel and said front cover are pivotally secured to said spine, and being selectively open on the other three sides;

a ring binder removably mounted in said ring binder space near said spine;

first and second zippers extending around the three open sides of said binder space and said storage space, respectively, to fully enclose the contents of said binder assembly; and the exterior of said binder assembly consisting solely of said covers and said zippers;

whereby a compact binder assembly is provided for holding hole-punched paper in said ring binder space, and loose papers and related writing materials in said storage space with minimal overall weight.

15. The assembly of claim 14, further comprising a first sidewall and a second sidewall, said first sidewall disposed between said rear cover and said intermediate cover, said second sidewall disposed between said intermediate panel and said front cover, said widewalls connected by said first zipper.

16. The assembly of claim 15, wherein said first sidewall has a width of about 2 inches and said second side wall has a width of about 1½ inches.

17. The assembly of claim 14, further comprising a reflective strip on a surface of said spine.

18. The assembly of claim 14, further comprising a plurality of storage arrangements on an inner surface of said front cover, said plurality of storage arrangements including a floppy disk storage arrangement, a calculator storage arrangement, and a writing utensil storage arrangement.

19. A partitioned binder assembly comprising:

a spine;

a rear cover, an intermediate panel and a front cover, each being pivotally mounted to said spine;

said rear cover and said intermediate panel defining a ring binder space for holding pages, closed on one side where the rear cover and panel are secured to the spine, and being selectively open on the other three sides;

said intermediate panel and said front cover defining a storage space closed on one side where said panel and said front cover are secured to said spine, and being selectively open on the other three sides;

a ring binder mounted in said ring binder space near said spine;

a plurality of separate storage arrangements mounted to said assembly in said storage space;

first and second zippers extending around the three open sides of said binder space and said storage space, respectively, to fully enclose the contents of said binder assembly;

a pocket on an inner surface of said rear cover;

said ring binder including a base member and rings coupled to said base member, said rings adapted to be opened for receiving sheet material having spaced holes along an inner edge for alignment with said rings; and said pocket slidingly receiving said base member such that said ring binder may be easily removed and inserted.

20. A partitioned binder assembly comprising:

a spine;

a rear cover, an intermediate panel and a front cover, each being pivotally mounted to said spine;

said rear cover and said intermediate panel defining a ring binder space for holding pages, closed on one side where said rear cover and said panel are secured to said spine, and being selectively open on the other three sides;

said intermediate panel and said front cover defining a storage space closed on one side where said panel and said front cover are secured to said spine, and being selectively open on the other three sides;

a ring binder removably mounted in said ring binder space near said spine;

first and second zippers extending around the three open sides of said binder space and said storage space, respectively, to fully enclose the contents of said binder assembly;

a pocket on an inner surface of said rear cover;

said ring binder including a base member and rings coupled to said base member, said rings adapted to be opened for receiving sheet material having spaced holes along an inner edge for alignment with said rings; and said pocket slidingly receiving said base member such that said ring binder may be readily removed and inserted.

* * * * *